US008203514B2

(12) United States Patent
Su et al.

(10) Patent No.: US 8,203,514 B2
(45) Date of Patent: Jun. 19, 2012

(54) COLOR SEQUENTIAL DISPLAY DEVICE

(75) Inventors: Ying-Chung Su, Tainan (TW); Shian-Jun Chiou, Taipei (TW); Jhen-Shen Liao, Taoyuan County (TW); Wen-Chih Tai, Taoyuan County (TW); Hun-Wei Chen, Taoyuan County (TW); Ming-Ta Hsieh, Taipei County (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 783 days.

(21) Appl. No.: 12/369,712

(22) Filed: Feb. 11, 2009

(65) Prior Publication Data

US 2010/0127959 A1 May 27, 2010

(30) Foreign Application Priority Data

Nov. 21, 2008 (TW) ..... 97145137 A

(51) Int. Cl.
*G09G 3/36* (2006.01)

(52) U.S. Cl. ..... 345/88; 345/99

(58) Field of Classification Search ..... None
See application file for complete search history.

(56) References Cited

U.S. PATENT DOCUMENTS

| | | | | |
|---|---|---|---|---|
| 2003/0020677 | A1 | 1/2003 | Nakano | |
| 2005/0146492 | A1 * | 7/2005 | Baba et al. | 345/87 |
| 2007/0057883 | A1 | 3/2007 | Cho et al. | |
| 2007/0097017 | A1 * | 5/2007 | Widdowson et al. | 345/1.3 |

FOREIGN PATENT DOCUMENTS

| | | | |
|---|---|---|---|
| CN | 1400488 | A | 3/2003 |
| CN | 101295480 | A | 10/2008 |

* cited by examiner

*Primary Examiner* — Paul Huber
(74) *Attorney, Agent, or Firm* — Winston Hsu; Scott Margo

(57) ABSTRACT

A color sequential liquid crystal display (LCD) device is disclosed in the present invention. The color sequential LCD device includes an LCD panel, a backlight module, an image processing circuit and a timing control circuit. The image processing circuit is utilized for performing image processing on an image data to generate a frame data with full color information, and sorting the frame data to generate a plurality of frame data based on a predetermined color sequence. The timing controller is utilized for controlling the LCD panel and the backlight module to display the plurality of field data outputted by the image processing circuit, so as to achieve color mixing in time domain.

19 Claims, 13 Drawing Sheets

COLOR SEQUENTIAL DISPLAY DEVICE

BACKGROUND OF THE INVENTION

1. Field of the Invention

The present invention relates to a color sequential liquid crystal display (LCD) device, and more particularly, to a color sequential LCD device that saves a frame buffer of a timing control circuit by use of a system side memory.

2. Description of the Prior Art

Generally, color mixing methods for a liquid crystal display (LCD) can be divided into two categories: a time-domain color mixing method and a space-domain color mixing method. Compared to the space-domain color mixing method, the time-domain method takes advantages of visual persistence of human eyes to display a particular color by quickly switching monochrome fields such as red (R), green (G) and blue (B). Thus, there is no need to use traditional color filters, resulting in advantages of lower production costs, higher light transmittance and so on.

For a color sequential LCD device that adopts the time-domain method, since an image frame with full-color information needs to be separated into monochrome fields before color mixing, a data sorting circuit has to be added into a timing controller of the LCD to sort the frame data coming from a system side such as a display card, for example, so as to output the monochrome fields to the LCD panel according to a predetermined color sequence. In addition, please refer to FIG. 1, which shows operation of a conventional data sorting circuit 10. As shown in FIG. 1, the timing controller requires memory space with at least one frame size for temporarily storing the sorted filed data, so that the monochrome fields, such as R-G-B, can be serially outputted to the LCD panel for display.

However, in an actual design, the prior art may utilize two frame buffers for alternatively storing frame data outputted from the system side. In this case, as shown in FIG. 2, one frame buffer is utilized for storing the frame data coming from the system side while the other is utilized for outputting the sorted field data to the LCD panel, so as to increase data processing efficiency. Related memory accessing technique is well-know by those skilled in the art, and is not narrated herein.

As mentioned above, the frame data with full-color information coming from the system side has to be sorted into the monochrome fields such as R-G-B, for example, in the color sequential LCD device. Thus, only after the whole frame data is completely transmitted by the system side, the corresponding monochrome fields can then be outputted to the LCD panel by the timing controller according to the predetermined color sequence. As a result, the prior art requires the memory space with at least one frame size for temporarily storing the sorted field data, and has disadvantages of poor efficiency.

SUMMARY OF THE INVENTION

It is therefore an objective of the present invention to provide a color sequential liquid crystal display (LCD) device and related image display method.

According to the present invention, a color sequential liquid crystal display (LCD) device is disclosed. The color sequential LCD device includes an LCD panel, a backlight module, an image processing circuit and a timing control circuit. The image processing circuit is utilized for performing image processing on an image data to generate a frame data with full-color information and for sorting the frame data to generate a plurality of field data according to a predetermined color sequence. The timing control circuit is coupled to the image processing circuit, the LCD panel and the backlight module, and includes a timing controller and a backlight controller. The timing controller is utilized for outputting the field data generated by the image processing circuit to the LCD panel. The backlight controller is utilized for controlling the backlight module to switch on back lights corresponding to the field data outputted by the timing controller.

According to the present invention, an image display method for a color sequential liquid crystal display (LCD) device is disclosed. The image display method includes steps of performing image processing on an image data to generate a frame data with full-color information and sorting the frame data to generate a plurality of field data according to a predetermined color sequence in an image processing circuit, outputting the plurality of field data to an LCD panel via a timing control circuit, and controlling a backlight module to switch on back lights corresponding to the field data outputted by the timing control circuit.

According to the present invention, a color sequential liquid crystal display (LCD) device is disclosed. The color sequential LCD device includes an LCD panel, an image processing circuit, a decoder and a timing control circuit. The image processing circuit is utilized for performing image processing on an image data to generate a frame data with full-color information and outputting a plurality of times of the frame data by frequency multiplication. The decoder is coupled to the image processing circuit, and is utilized for decoding each output of the frame data to generate a plurality of field data according to a predetermined color sequence. The timing control circuit is coupled to the decoder and the LCD panel, and is utilized for generating driving signals of the LCD panel according to the field data outputted by the decoder to control the LCD panel to sequentially display the field data.

According to the present invention, an image display method for a color sequential liquid crystal display (LCD) device is disclosed. The image display method includes steps of performing image processing on an image data to generate a frame data with full-color information and outputting a plurality of times of the frame data by frequency multiplication, decoding each output of the frame data to generate a plurality of field data according to a predetermined color sequence, and generating driving signals of an LCD panel according to the plurality of field data to control the LCD panel to sequentially display the plurality of field data.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
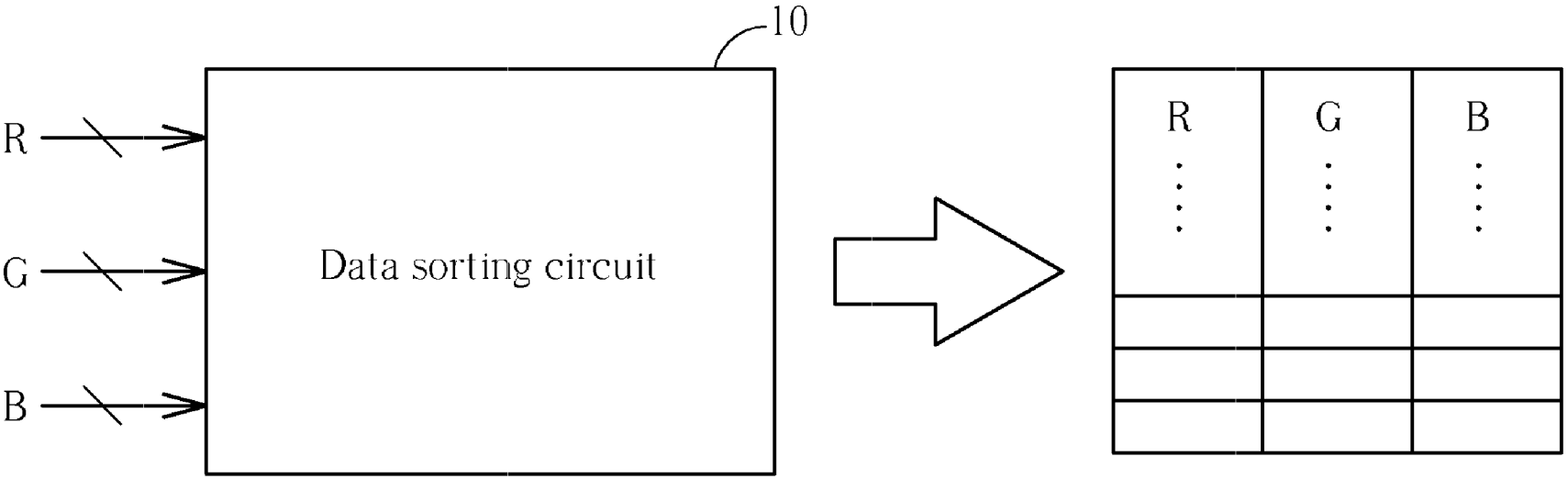
FIG. 1 PRIOR ART
FIG. 1 shows operation of a conventional data sorting circuit.
Figure 2:
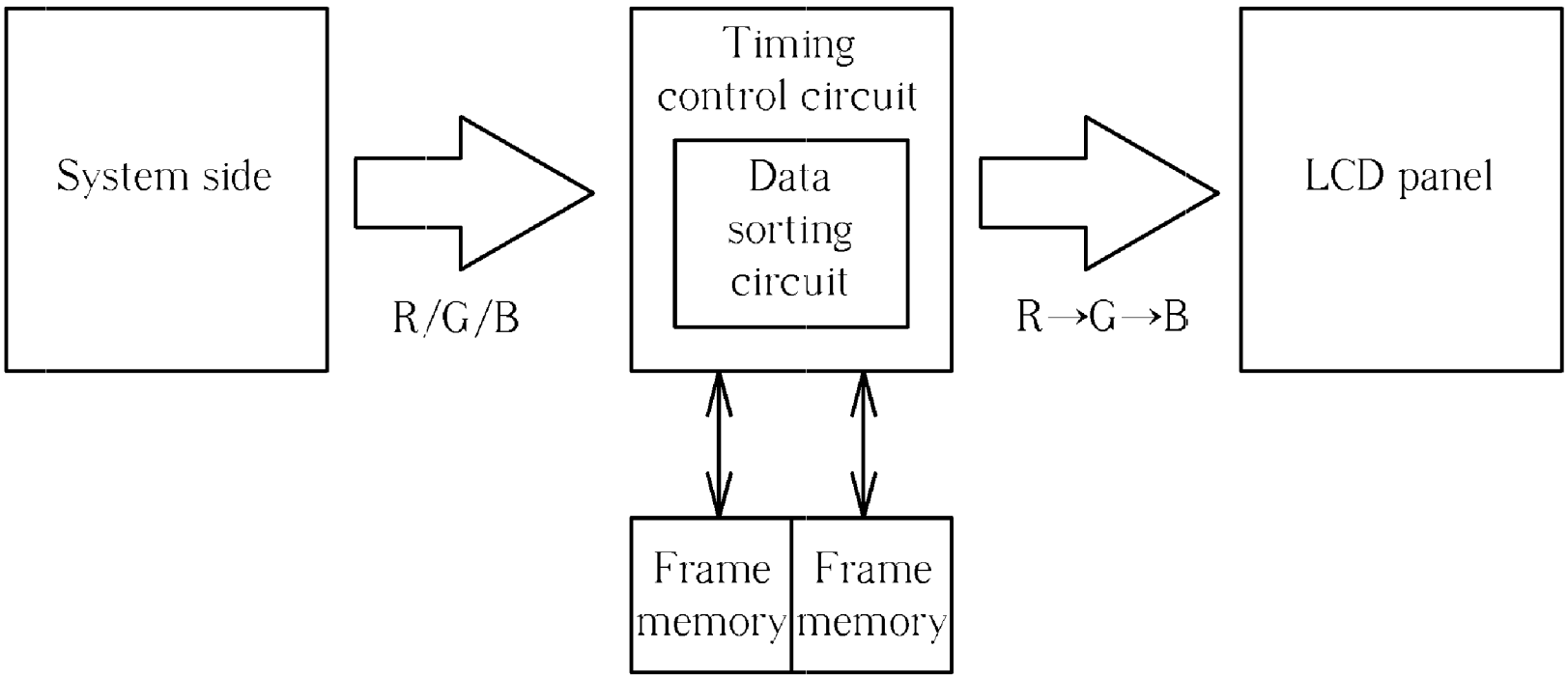
FIG. 2 PRIOR ART
FIG. 2 is a schematic diagram of a traditional color sequential LCD device.
Figure 3:
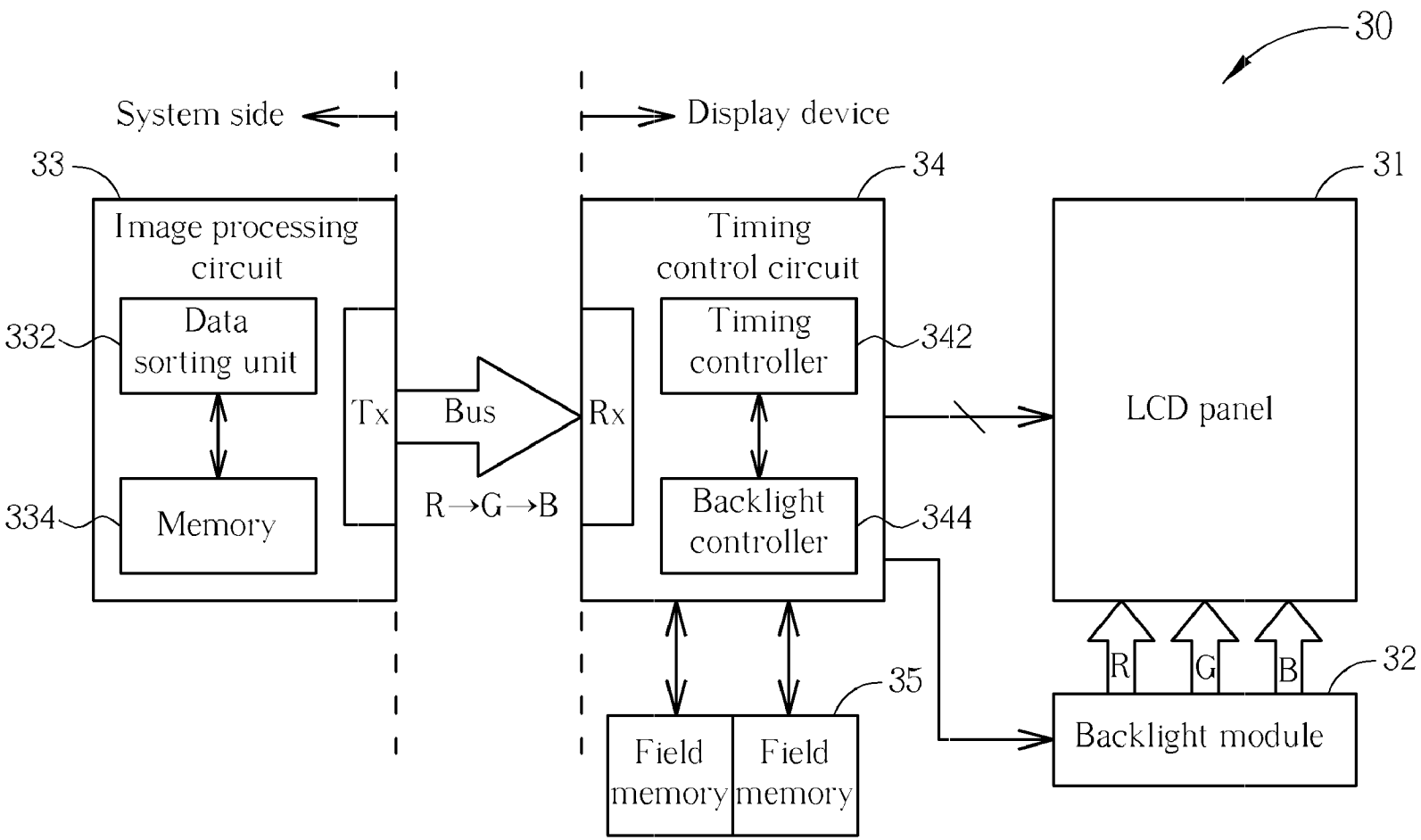
FIG. 3 is a schematic diagram of a color sequential LCD device according to an embodiment of the present invention.

Please refer to FIG. 3. FIG. 3 is a schematic diagram of a color sequential liquid crystal display (LCD) device 30 according to an embodiment of the present invention. The color sequential LCD device 30 includes an LCD panel 31, a backlight module 32, an image processing circuit 33 and a timing control circuit 34. The image processing circuit 33 is arranged at a system side such as a display card, for example, and is utilized for performing image processing on an image data to generate a frame data with full-color information. The image processing circuit 33 further includes a data sorting unit 332 and a frame memory 334. The data sorting unit 332 is utilized for sorting the frame data to generate a plurality of field data such as red (R), green (G) and blue (B), for example. The frame memory 334 is coupled to the data sorting unit 332, and is utilized for temporarily storing the sorted field data. Thus, the image processing circuit 33 can output the plurality of field data in series according to a predetermined color sequence, wherein the predetermined color sequence can be R-G-B, R-G-B-G, R-G-B-W(White), R-G-B-W-Y(Yellow) and R-G-B-C(Cyan)-Y-M(Magenta) and is not limited herein.

The timing control circuit 34 is coupled to the image processing circuit 33, the LCD panel 31 and the backlight module 32, and is utilized for controlling the LCD panel 31 and the backlight module 32 to sequentially display the field data outputted by the image processing circuit 33, so as to achieve color mixing on time domain. Preferably, the timing control circuit 34 includes a timing controller 342 and a backlight controller 344. The timing controller 342 is utilized for generating driving signals of the LCD panel 31 according to the field data outputted by the image processing circuit 33. The backlight controller 344 is utilized for generating backlight control signals to control the backlight module 32 to switch on corresponding back lights according to display time of the field data outputted by the timing controller 342. In addition, the color sequential LCD device 30 further includes a data transmission interface Tx/Rx, coupled to the image processing circuit 33 and the timing control circuit 34, for serially transmitting the plurality of field data to the timing control circuit 34 by a maximum bandwidth according to the predetermined color sequence. The data transmission interface Tx/Rx can be a Low-Voltage Differential Signaling (LVDS) interface or a Display Port (DP) transmission interface, and is not limited herein.

Therefore, in the color sequential LCD device 30 of the present invention, the frame data is sorted in the image processing circuit 33 (i.e. the system side), so that the monochrome fields such as R-G-B can be outputted to the timing control circuit 34 according to the predetermined color sequence. In such a situation, the timing control circuit 34 can control the LCD panel 31 and the backlight module 32 to sequentially display the field data outputted by the image processing circuit 33, so as to achieve the color mixing on time domain.

In other words, the embodiment of the present invention utilizes the frame memory of the system side for sorting the frame data and serially outputs the sorted field data to the timing control circuit, so that not only complexity of the hardware system can be simplified but also the memory usage of the timing control circuit can be reduced, leading to lower production cost.

Figure 4:
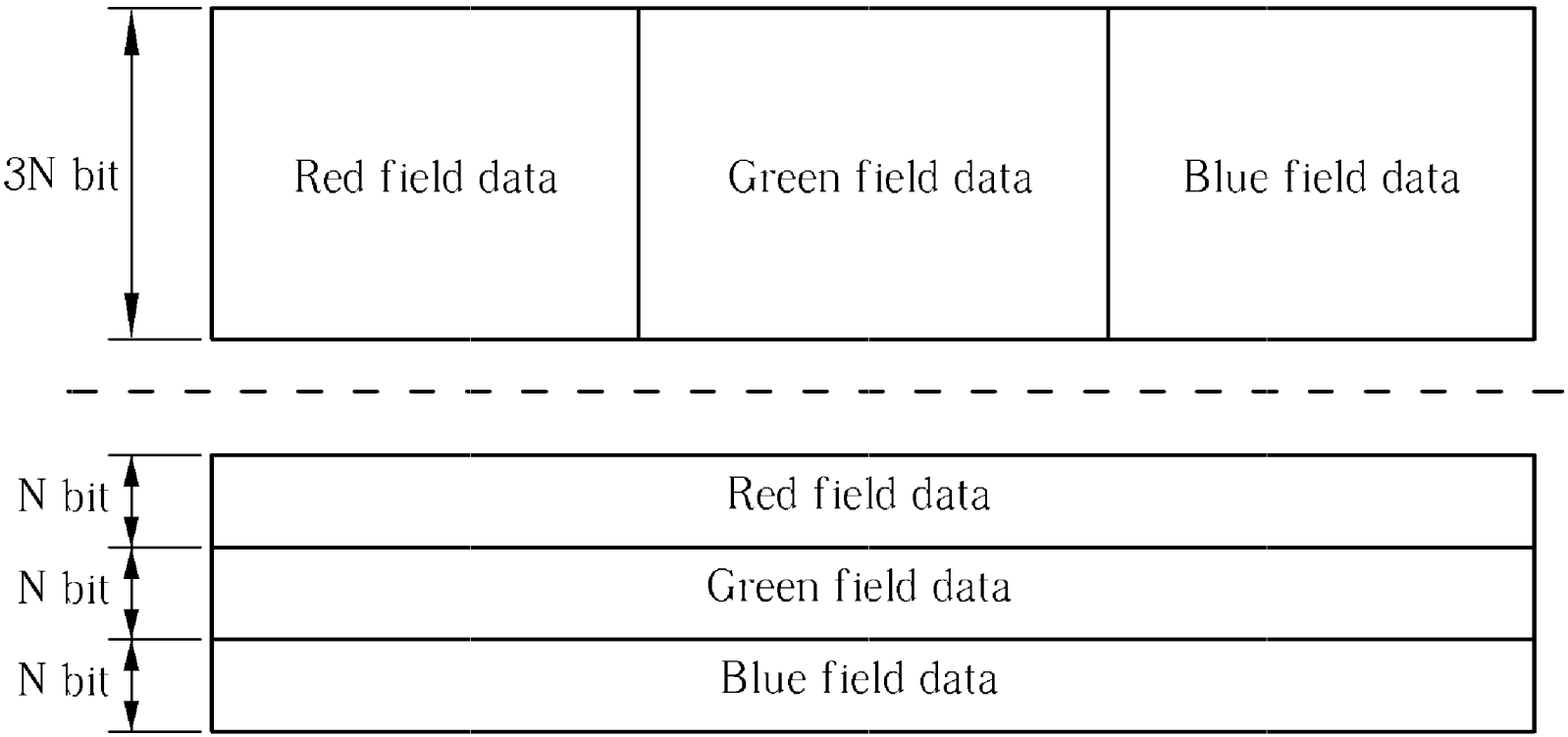
FIG. 4 shows the data transmission interface of FIG. 3 that serially transmits monochrome fields to the timing control circuit.

Please refer to FIG. 4, which shows the data transmission interface of FIG. 3 that serially transmits three monochrome fields to the timing control circuit. In FIG. 4, assume the data transmission interface can simultaneously transmit 3N bits to the timing control circuit, since the frame data is already sorted in the system side and temporarily stored in the system memory, the embodiment of the present invention can serially transmits the monochrome fields to the timing control circuit by use of the 3N bits at the same time, as shown in upper half of FIG. 4. That is to say, compared to traditional structures that individually use N bits to transmit the three monochrome field data, as shown in lower half of FIG. 4, the data quantity that the field data can be transferred per unit time is three times increased in the embodiment of the present invention.

Besides, assume the data transmission interface has a bandwidth of 3×8 bits and the image processing circuit 33 merely uses 6 bits to denote each pixel of the monochrome fields, the data transmission interface can thus transmits 4 pixels of the field data at the same time, so as to optimize the bandwidth usage of the data transmission interface. Such variation also belongs to the scope of the present invention.

Please further refer to FIG. 3. The timing control circuit 34 can further includes a field memory 35, for buffering the field data outputted by the image processing circuit 33. Preferably, the field memory 35 is implemented by memory space with a size of two monochrome fields. In this case, half of the field memory is utilized for storing the field data outputted by the image processing circuit 33 while the other half is utilized for outputting the field data that is completely received, so as to increase memory accessing efficiency. Related memory accessing technique is well-know by those skilled in the art, and is not narrated herein. Thus, the timing control circuit 34 can sequentially output the field data that is completely received to the LCD panel, and controls the backlight module to switch on the back lights of corresponding colors, so as to achieve color mixing on time domain.

Figure 5:
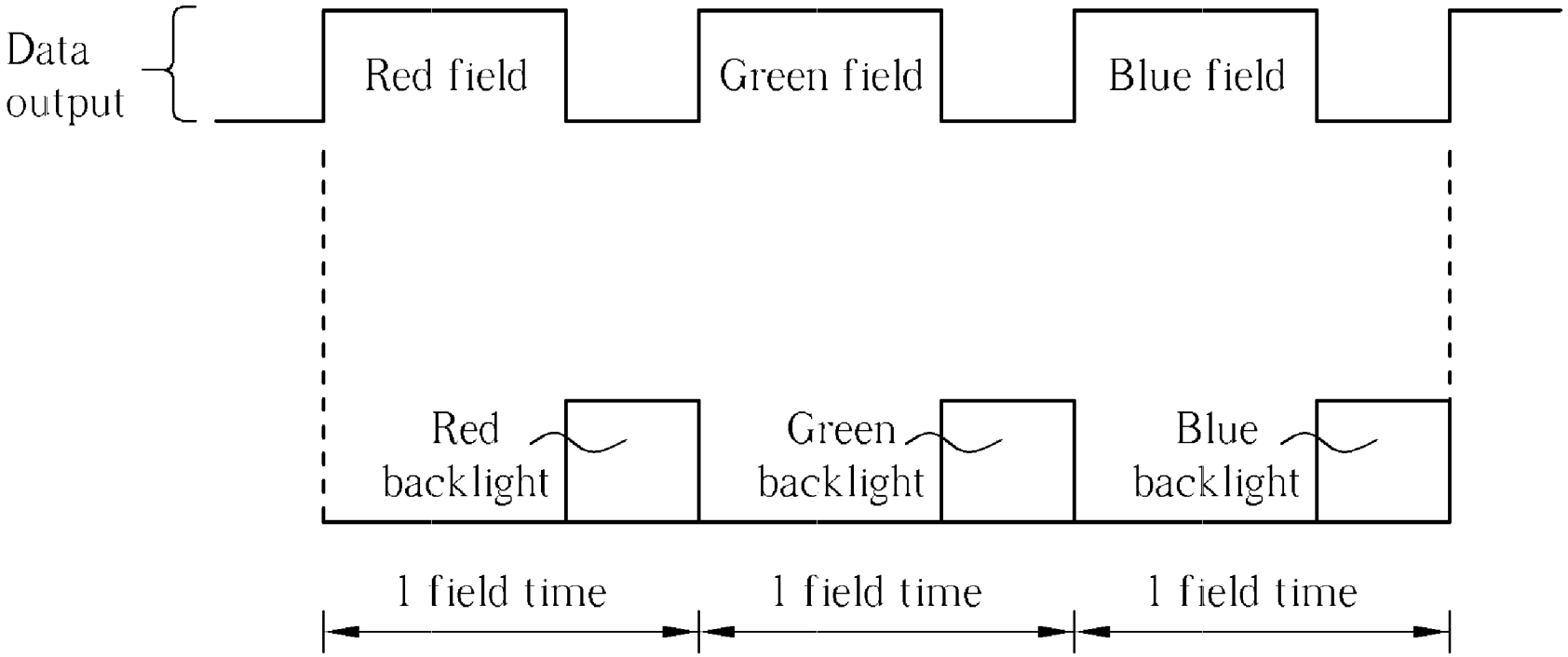
FIG. 5 shows signal timing of the timing control circuit of FIG. 3.

As for signal timing of the timing control circuit 34, please refer to FIG. 5. In FIG. 5, the timing control circuit 34 sequentially outputs the completely received field data to the LCD panel 31, and the backlight module 32 switches on the back lights of the corresponding colors, so as to display a full-color image by color mixing on time domain.

Therefore, compared with the traditional structures, the embodiment of the present invention not only can save memory usage of the timing control circuit (at least reduce to two-third of the traditional structures), but also can simplify the complexity of the hardware system to lower the production cost.

Figure 6:
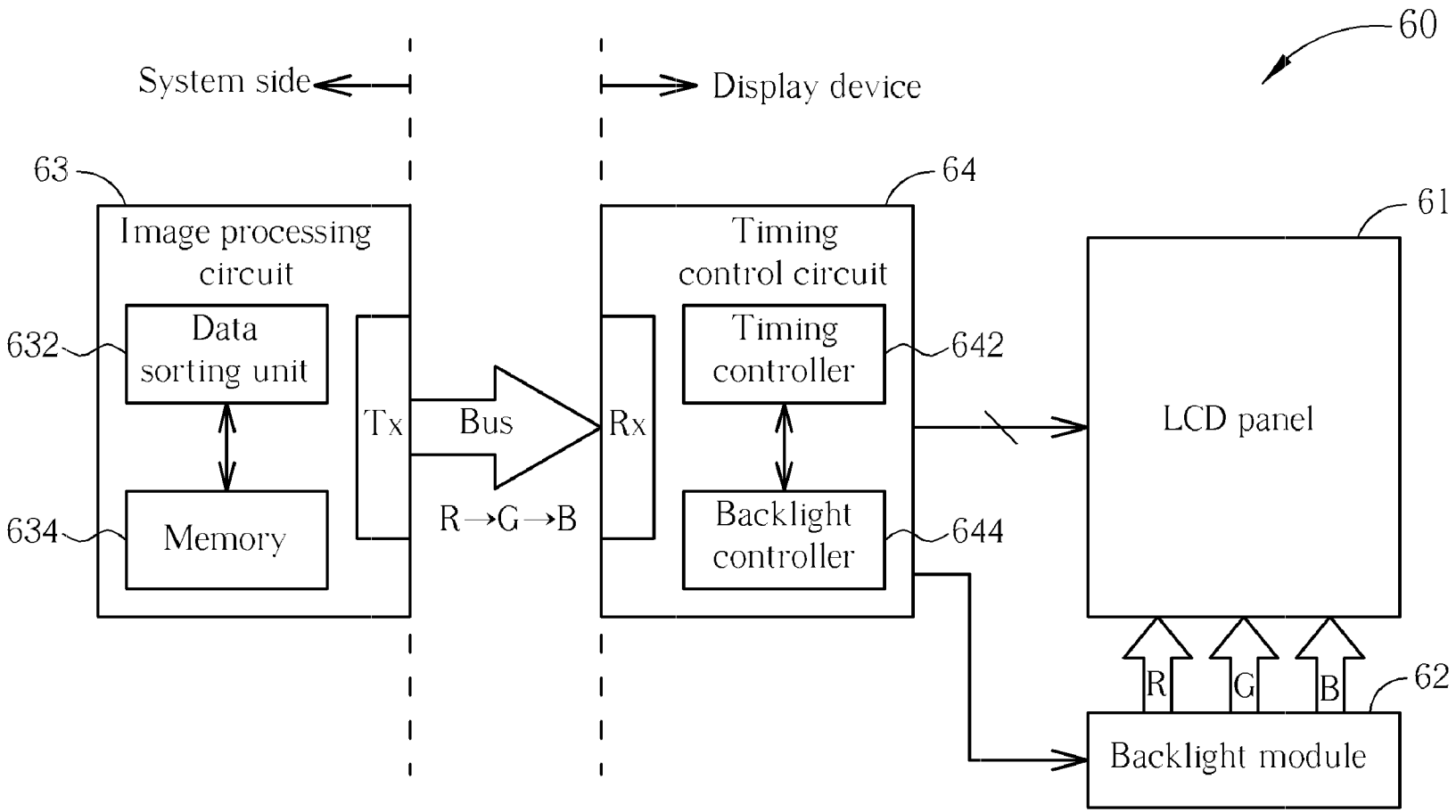
FIG. 6 is a schematic diagram of a color sequential LCD device according to a preferred embodiment of the present invention.

On the other hand, please refer to FIG. 6. FIG. 6 is a schematic diagram of a color sequential LCD device 60 according to a preferred embodiment of the present invention. Compared to FIG. 3, the color sequential LCD device 60 can further save usage of the field memory, and can directly output the field data outputted form the system side to the LCD panel 61. In this embodiment, the color sequential LCD device 60 utilizes a scanning backlight module rather than the conventional backlight module. In such a situation, the LCD panel 61 can further include a plurality of scanning blocks (not shown in FIG. 6), for example, and the backlight module 62 can sequentially switch on the back lights corresponding to the plurality of scanning blocks according to the time the filed data being outputted to the plurality of scanning blocks. As a result, when the field data is read out from the system side memory, it can be directly outputted to the LCD panel 61 via the timing control circuit 64, so as to save the usage of the memory.

Figure 7:
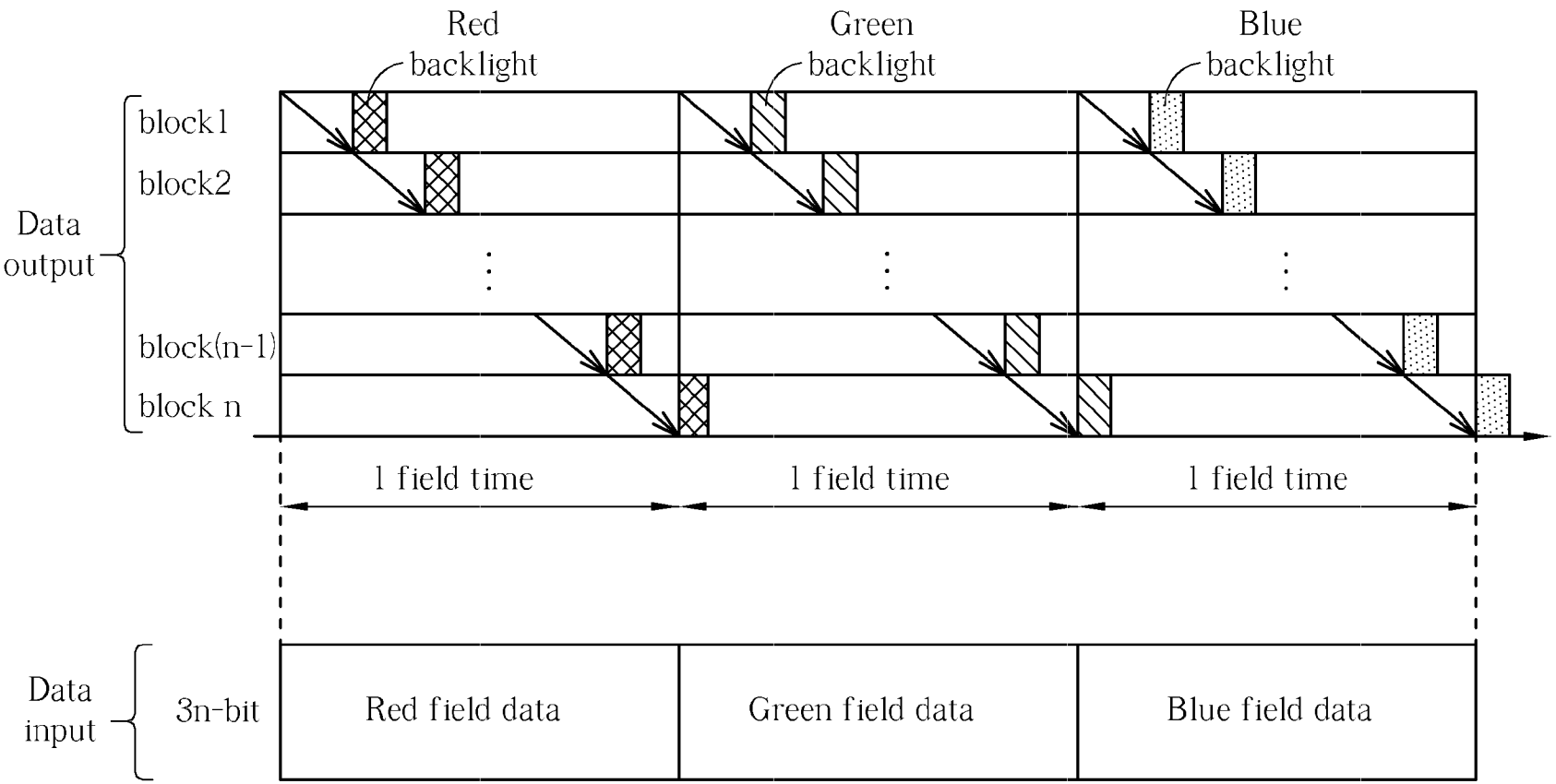
FIG. 7 shows signal timing of the timing control circuit of FIG. 6.

For example, please refer to FIG. 7, which shows signal timing of the timing control circuit 64 of FIG. 6. As shown in FIG. 7, BLK1~BLKn denote scanning blocks of the LCD panel, respectively. When the field data corresponding to the scanning block BLK1 is completely outputted to the LCD panel, the back lights of the scanning block BLK1 are immediately switched on, and the timing control circuit keeps outputting the field data corresponding to the scanning block BLK2 to the LCD panel. The field data corresponding to the remaining scanning blocks are outputted in a same manner until the timing control circuit completes data output of the last scanning block BLKn and starts to output the next field data. That is to say, by using the scanning backlight module, the backlight switch operation would not affect the data transmission of the field data. Thus, the timing controller can directly output the field data outputted from the system side to the LCD panel, and thus can save the use of the field memory.

Figure 12:
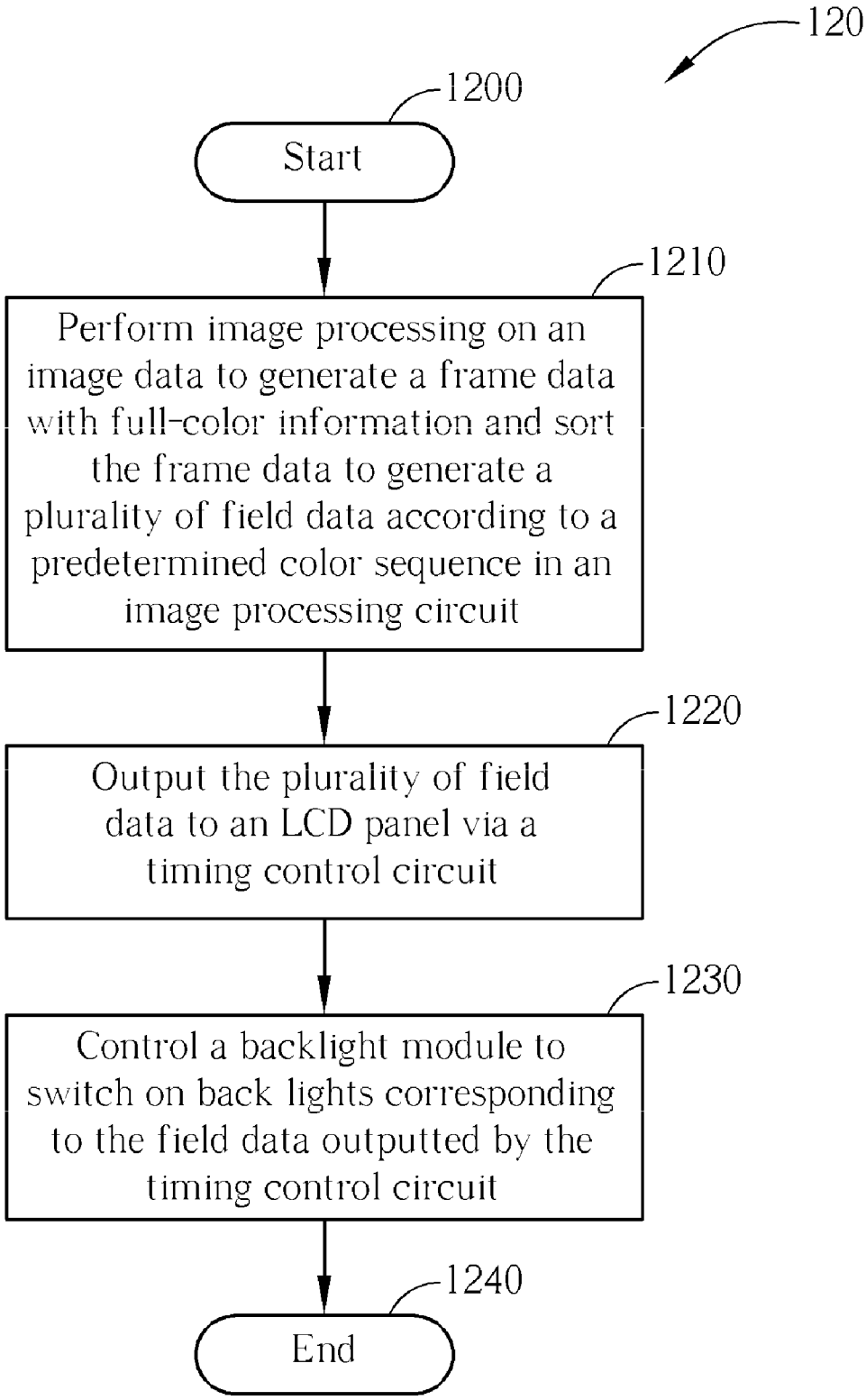
FIG. 12 and FIG. 13 are schematic diagrams of an image display process for a color sequential LCD device according to an embodiment of the present invention, respectively.

Please refer to FIG. 12. FIG. 12 is a schematic diagram of an image display process 120 for a color sequential LCD device according to an embodiment of the present invention. The image display process 120 is an operation process of the color sequential LCD device 30 and 60, and includes the following steps:

Step 1200: Start.

Step 1210: Perform image processing on an image data to generate a frame data with full-color information and sort the frame data to generate a plurality of field data according to a predetermined color sequence in an image processing circuit.

Step 1220: Output the plurality of field data to an LCD panel via a timing control circuit.

Step 1230: Control a backlight module to switch on back lights corresponding to the field data outputted by the timing control circuit.

Step 1240: End.

Detailed operation of the image display process 120 is already described in the embodiments of the color sequential LCD device 30 and 60, and is not narrated again herein.

Figure 8:
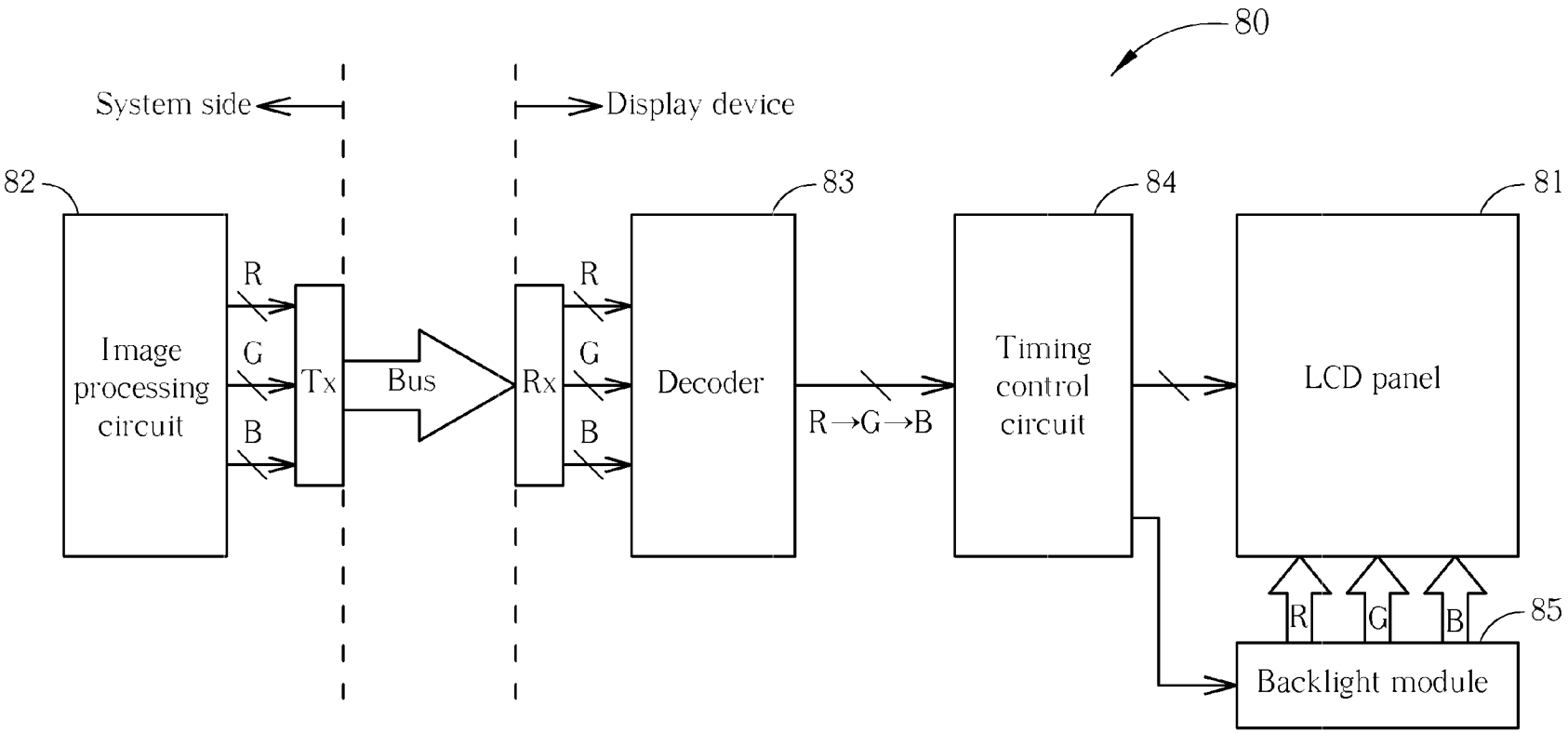
FIG. 8 is a schematic diagram of a color sequential LCD device according to an embodiment of the present invention.

Moreover, for saving the frame memory required by the timing control circuit, the color sequential LCD device can also be implemented by other hardware structures in the present invention. Please refer to FIG. 8. FIG. 8 is a schematic diagram of a color sequential LCD device 80 according to an embodiment of the present invention. The color sequential LCD device 80 includes an LCD panel 81, an image processing circuit 82, a data transmission interface Tx/Rx, a decoder 83 and a timing control circuit 84. The image processing circuit 82 is arranged at a system terminal such as a display card, for example, and is utilized for performing image processing on an image data to generate a frame data with full-color information and outputting a plurality of times of the frame data by frequency multiplication. The data transmission interface Tx/Rx is coupled to the image processing circuit 82, and is utilized for transmitting each output of the frame data. The decoder 83 is coupled to the data transmission interface Tx/Rx, and is utilized for decoding each output of the frame data to generate a plurality of monochrome fields such as R-G-B, for example, according to a predetermined color sequence. Preferably, the number of the plurality of field data is equal to that of the plurality of times the frame data being outputted. The timing control circuit 84 is coupled to the decoder 83 and the LCD panel 81, and is utilized for controlling the LCD panel 81 and the backlight module 85 to sequentially display the monochrome fields outputted by the decoder 83, so as to achieve color mixing on time domain.

That is to say, the embodiment of the present invention utilizes the image processing circuit 82 for outputting a plurality of identical frame data by frequency multiplication, and decodes the plurality of identical frame data by the decoder 83 to generate the monochrome fields such as R-G-B according to the predetermined color sequence. As a result, the timing control circuit 84 can control the LCD panel 81 and the backlight module 85 to sequentially display the monochrome fields outputted by the decoder 83, so as to achieve color mixing on time domain. Therefore, the embodiment of the present invention not only can save usage of the frame memory inside the timing control circuit, but also can significantly reduce design complexity of the LCD device since behaviors of the image processing circuit and ways to transmitting the frame data need not to be modified particularly.

Figure 9:
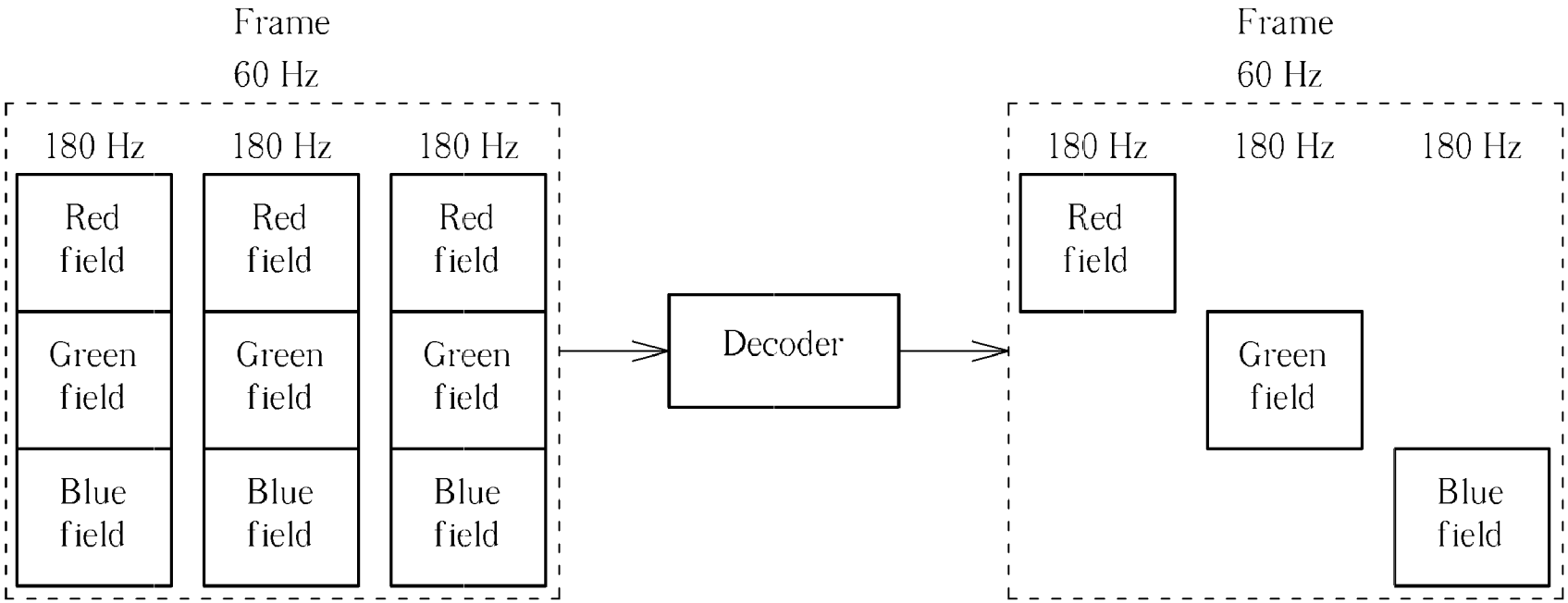
FIG. 9 shows operation of the decoder of FIG. 8 according to an embodiment of the present invention.

For example, please refer to FIG. 9, which shows operation of the decoder 83 of FIG. 8 according to an embodiment of the present invention. Assume the color sequential LCD device 80 is about to display the monochrome fields by the predetermined color sequence such as R-G-B, compared to the traditional structures that transmit the frame data by an operation frequency of 60 Hertz, the embodiment of the present invention transmits three identical frame data to the decoder 83 by an operation frequency of 180 Hertz, so that the decoder 83 can successively decode the three frame data to generate red field data, green field data and blue field data, as shown in FIG. 9.

It is noted that the above embodiments of the present invention are merely exemplary illustrations of the present invention and that those skilled in the art can certainly make modifications according to practical demands, which are not limited herein. For example, the color sequential LCD device can also display the monochrome fields by a predetermined color sequence such as R-G-B-G, or by inserting black color fields to enhance quality of motion pictures.

Figure 10:
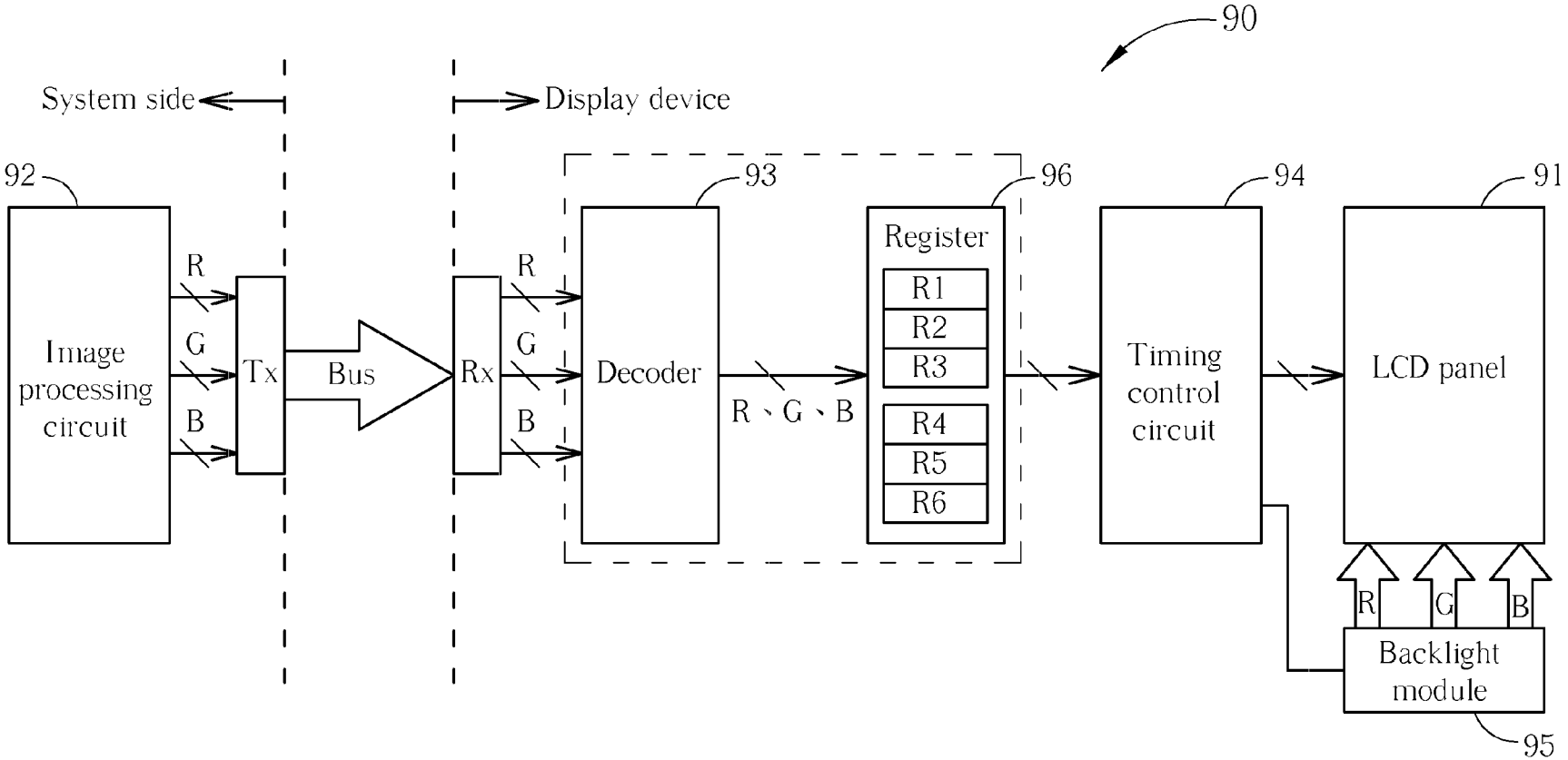
FIG. 10 and FIG. 11 are also schematic diagrams of a color sequential LCD device according to an embodiment of the present invention.

Besides, please refer to FIG. 10. FIG. 10 is a schematic diagram of a color sequential LCD device 90 according to an embodiment of the present invention. Compared to FIG. 8, the color sequential LCD device 90 further includes a register 96, coupled between the decoder 93 and the timing control circuit 94, for buffering the field data outputted by the decoder 93 to reduce operation frequency of the timing control circuit. For example, assume the register 96 includes six register blocks R1~R6 for individually registering a pixel data, the pixel data outputted by the decoder 93 can thus be registered into the register blocks R1~R3 and then transmitted to the timing control circuit 94 at the same, while the following pixel data can be sequentially registered into the block R4~R6 by like manners. Detailed operation of the color sequential LCD device 90 is similar to that of the color sequential LCD device 80, and is not described again herein.

Figure 11:
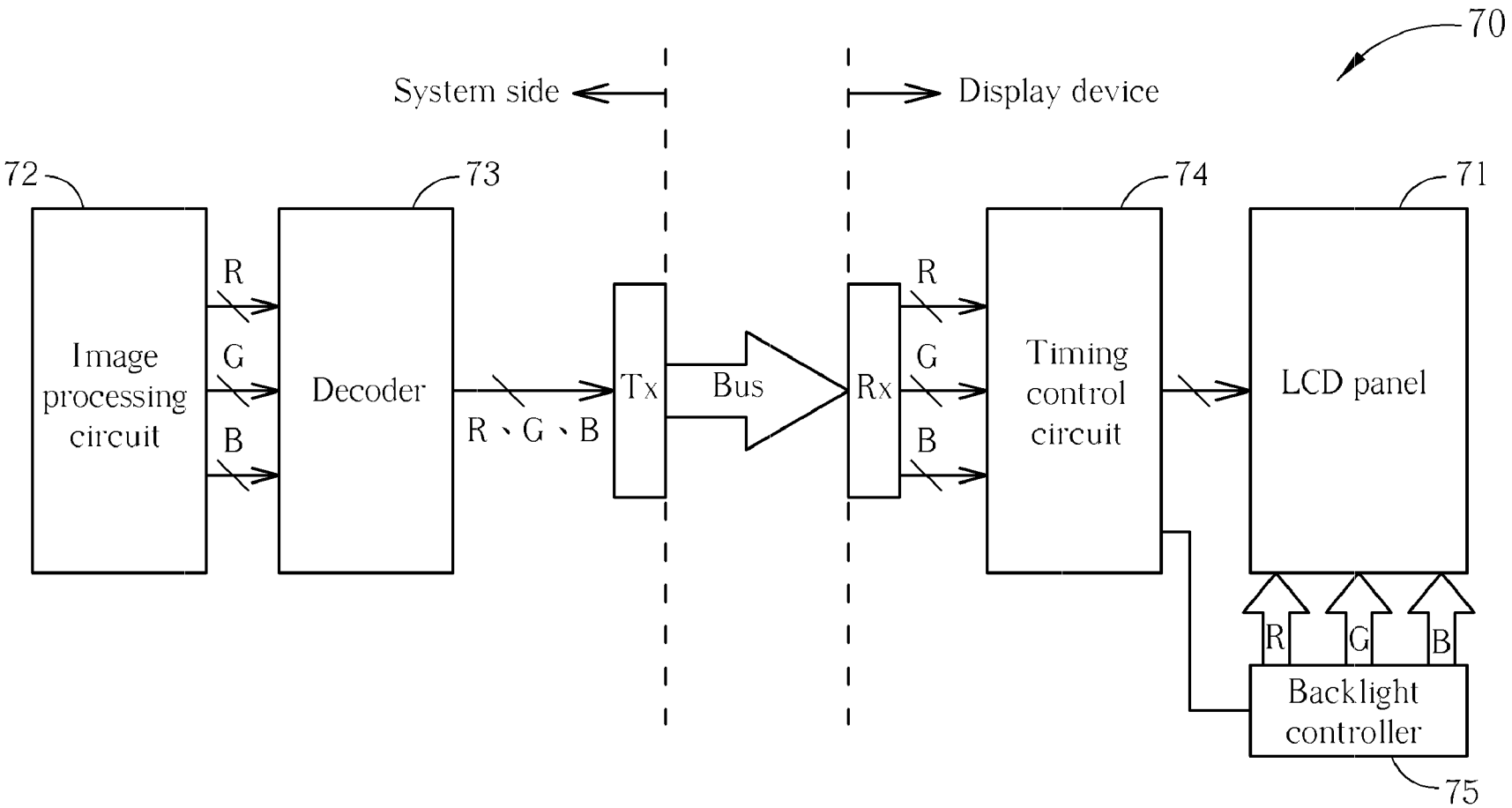

Please further refer to FIG. 11. FIG. 11 is a schematic diagram of a color sequential LCD device 70 according to an embodiment of the present invention. Compared to FIG. 8, the color sequential LCD device 70 is realized by arranging the decoder 73 at the system side. In this case, the data transmission interface Tx/Rx is utilized for transmitting the field data generated by the decoder 73 to the timing control circuit 74, so as to control the LCD panel 71 to display corresponding images. Detailed operation of the color sequential LCD device 70 is also similar to that of the color sequential LCD device 80, and is not described again herein.

Figure 13:
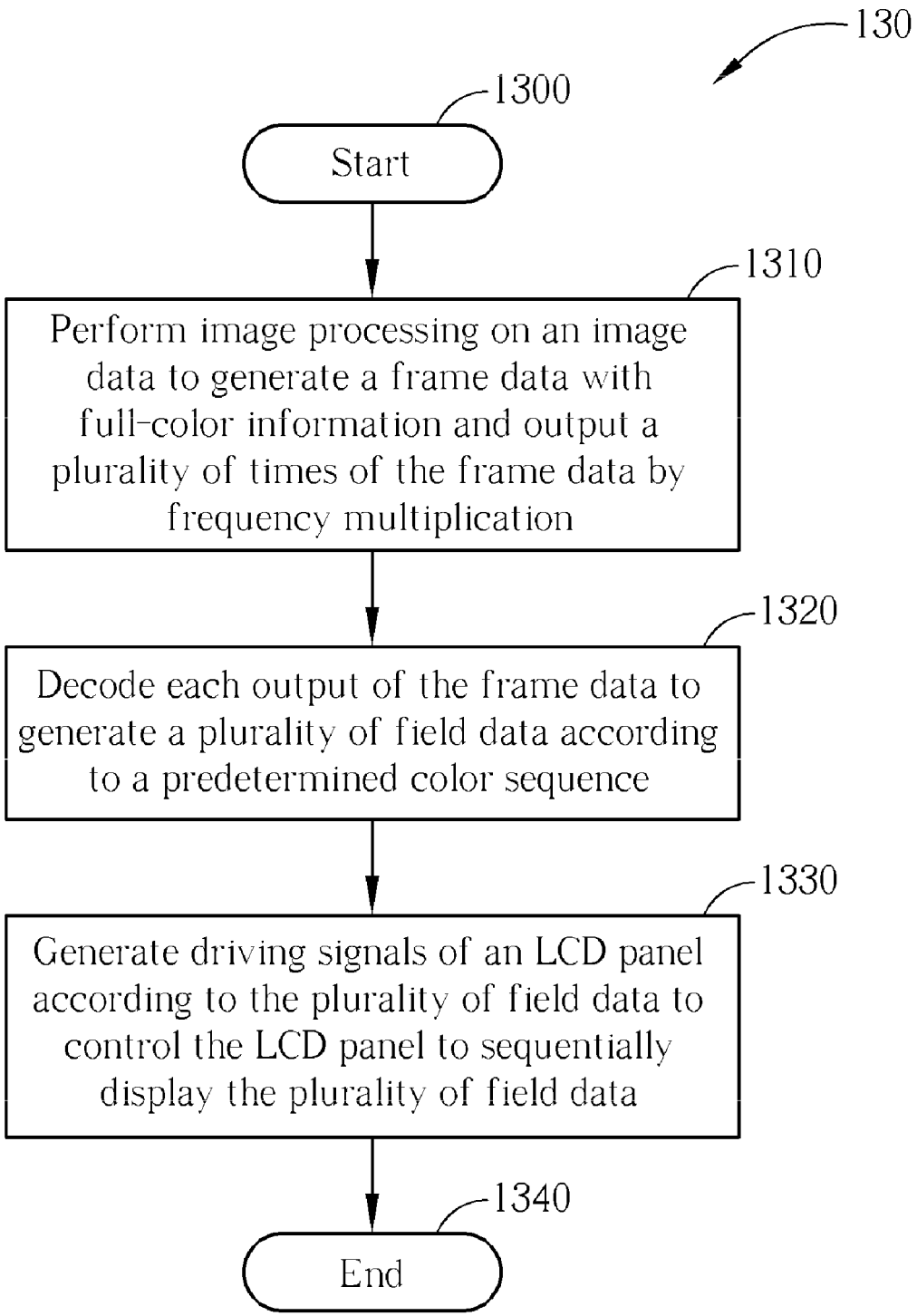

Please refer to FIG. 13. FIG. 13 is a schematic diagram of an image display process 130 for a color sequential LCD device according to an embodiment of the present invention. The image display process 130 is an operation process of the color sequential LCD device 70, 80 and 90, and includes the following steps:

Step 1300: Start.

Step 1310: Perform image processing on an image data to generate a frame data with full-color information and output a plurality of times of the frame data by frequency multiplication.

Step 1320: Decode each output of the frame data to generate a plurality of field data according to a predetermined color sequence.

Step 1330: Generate driving signals of an LCD panel according to the plurality of field data to control the LCD panel to sequentially display the plurality of field data.

Step 1340: End.

Detailed operation of the image display process 130 is already described in the embodiments of the color sequential LCD device 70, 80 and 90, and is not narrated again herein.

In short, the embodiment of the present invention generates multiple identical frame data by frequency multiplication and decodes the multiple identical frame data to output the monochrome fields according to the predetermined color sequence, so as to save usage of the frame memory inside the timing control circuit. In addition, since behaviors of the image processing circuit and ways to transmitting the frame data need not to be modified in the embodiment of the present invention, design complexity of the color sequential LCD device can be reduced significantly.

As mentioned above, the present invention provides various improved structures of the color sequential LCD device for saving usage of frame memory inside the timing control circuit, so that the production cost can be reduced.

Those skilled in the art will readily observe that numerous modifications and alterations of the device and method may be made while retaining the teachings of the invention.

What is claimed is:

1. A color sequential liquid crystal display (LCD) device comprising:

an LCD panel;

a backlight module;

an image processing circuit for performing image processing on an image data to generate a frame data with full-color information and for sorting the frame data to generate a plurality of field data according to a predetermined color sequence; and a timing control circuit, coupled to the image processing circuit, the LCD panel and the backlight module, comprising:

a timing controller for outputting the field data generated by the image processing circuit to the LCD panel; and a backlight controller for controlling the backlight module to switch on back lights corresponding to the field data outputted by the timing controller.

2. The color sequential LCD device of claim 1, wherein the image processing circuit comprises:

a data sorting unit for sorting the frame data to generate the plurality of field data; and a frame memory, coupled to the data sorting unit, for temporarily storing the sorted field data.

3. The color sequential LCD device of claim 1, wherein the timing control circuit further comprises:

a field memory for buffering the field data generated by the image processing circuit, wherein capacity of the field memory is not more than twice the size of the field data.

4. The color sequential LCD device of claim 3, wherein the backlight controller controls the backlight module to switch on the back lights with a corresponding color when the field data is completely outputted to the LCD panel.

5. The color sequential LCD device of claim 1, wherein the LCD panel comprises a plurality of scanning blocks, and the backlight controller controls the backlight module to sequentially switch on the back lights corresponding to the plurality of scanning blocks according to time the field data being outputted to the plurality of scanning blocks.

6. The color sequential LCD device of claim 5, wherein the backlight module is a scanning backlight module.

7. The color sequential LCD device of claim 1 further comprising a data transmission interface, coupled between the image processing circuit and the timing control circuit, for transmitting the plurality of field data to the timing control circuit according to the predetermined color sequence.

8. The color sequential LCD device of claim 7, wherein the data transmission interface transmits the plurality of field data in series with a maximum bandwidth.

9. The color sequential LCD device of claim 7, wherein the data transmission interface is selected from a data transmission interface group, the data transmission interface group comprising a Low-Voltage Differential Signaling (LVDS) interface and a Display Port (DP) transmission interface.

10. The color sequential LCD device of claim 1, wherein the predetermined color sequence is selected from a predetermined color sequence group, the predetermined color sequence group comprising R(Red)-G(Green)-B(Blue), R-G-B-G, R-G-B-W(White), R-G-B-W-Y(Yellow) and R-G-B-C(Cyan)-Y-M(Magenta).

11. The color sequential LCD device of claim 1, wherein the image processing circuit is selected from an image processing circuit group, the image processing circuit group comprising a display card and a video board.

12. An image display method for a color sequential liquid crystal display (LCD) device, the image display method comprising:

performing image processing on an image data to generate a frame data with full-color information and sorting the frame data to generate a plurality of field data according to a predetermined color sequence in an image processing circuit;

outputting the plurality of field data to an LCD panel via a timing control circuit; and controlling a backlight module to switch on back lights corresponding to the field data outputted by the timing control circuit.

13. The image display method of claim 12, wherein the timing control circuit further comprises:

a field memory for buffering the field data outputted by the image processing circuit, wherein capacity of the field memory is not more than twice the size of the field data.

14. The image display method of claim 13, wherein controlling the backlight module to switch on the back lights corresponding to the field data outputted by the timing control circuit comprises:

controlling the backlight module to switch on the back lights with a corresponding color when the field data is completely outputted to the LCD panel.

15. The image display method of claim 12, wherein the LCD panel comprises a plurality of scanning blocks.

16. The image display method of claim 15, wherein controlling the backlight module to switch on the back lights corresponding to the field data outputted by the timing control circuit comprises:

controlling the backlight module to sequentially switch on the back lights corresponding to the plurality of scanning blocks according to time the filed data being outputted to the plurality of scanning blocks.

17. The image display method of claim 12 further comprising:

transmitting the plurality of field data to the timing control circuit via a data transmission interface.

18. The image display method of claim 17, wherein the data transmission interface transmits the plurality of field data in series with a maximum bandwidth.

19. The image display method of claim 12, wherein the predetermined color sequence is selected from a predetermined color sequence group, the predetermined color sequence group comprising R(Red)-G(Green)-B(Blue), R-G-B-G, R-G-B-W(White), R-G-B-W-Y(Yellow) and R-G-B-C(Cyan)-Y-M(Magenta).

* * * * *